US006633794B2

(12) United States Patent
Bailie

(10) Patent No.: US 6,633,794 B2
(45) Date of Patent: Oct. 14, 2003

(54) SOFTWARE PROGRAM AND SYSTEM FOR REMOVING UNDERLYING STITCHES IN AN EMBROIDERY MACHINE DESIGN

(76) Inventor: Brian D. Bailie, 9913 Toltec NE., Albuquerque, NM (US) 87111

( * ) Notice: Subject to any disclaimer, the term of this patent is extended or adjusted under 35 U.S.C. 154(b) by 147 days.

(21) Appl. No.: 09/792,538

(22) Filed: Feb. 23, 2001

(65) Prior Publication Data

US 2002/0120358 A1 Aug. 29, 2002

(51) Int. Cl.[7] ..... D05C 5/02
(52) U.S. Cl. ..... 700/138; 700/136; 700/137
(58) Field of Search ..... 700/130–144; 28/241–242, 248–251

(56) References Cited

U.S. PATENT DOCUMENTS 5,343,401 A * 8/1994 Goldberg et al. ..... 700/138
5,558,033 A * 9/1996 Futamura et al. ..... 700/136
5,894,294 A * 4/1999 Morita ..... 700/136
6,004,018 A * 12/1999 Kawasato et al. ..... 700/138

* cited by examiner

*Primary Examiner*—Leo Picard
*Assistant Examiner*—W. Russell Swindell
(74) *Attorney, Agent, or Firm*—Senniger, Powers, Leavitt & Roedel

(57) ABSTRACT

A software program for analyzing an embroidery design of stitches which design will be used by an embroidery machine to create an embroidered fabric. Grid software divides the embroidery design to be analyzed into a plurality of grid sections. Identifying software identifies each grid section having a stitch which is partially or completely underlying another stitch. Modification software removes underlying stitches or a portion thereof in each identified grid section. The size of each grid section may be increased or decreased in proportion to a stretch of the thread to be used to create the embroidered fabric.

24 Claims, 6 Drawing Sheets

SOFTWARE PROGRAM AND SYSTEM FOR REMOVING UNDERLYING STITCHES IN AN EMBROIDERY MACHINE DESIGN

BACKGROUND OF THE INVENTION

The invention relates to a software program and system for assisting an operator in analyzing an embroidery design which will be used by an embroidery machine to create an embroidered fabric. In particular, the invention assists the operator in analyzing and/or removing underlying stitching of an embroidery design.

In order for an operator of an embroidery machine to know how well a design will sew, the operator must actually sew the design as a test. This process of making a test design can be extremely time consuming, given that the average machine will sew at a rate of 400 stitches per minute, and designs are typically in the 10,000–80,000 stitch range. There is a need for a system which can assist the operator in evaluating a design to minimize or avoid the need for sewing the design or part of it as a test.

It is quite often that a desired embroidery product will use multiple embroidered designs that have sections overlapping one another. It is also quite typical an operator will place a filled area of stitches over another area that has been filled with stitches in the process of digitizing (creating an embroidery design). Regardless of the cause of underlying stitching, these stitches presents a problem for the operator of the embroidery machine because the design now has so many stitches that the needle of the embroidery machine may have difficulty penetrating the fabric.

There is a need for a system which compensates for underlying stitches. There also is a need for a system and method for assisting an operator in determining, evaluating and/or removing underlying stitching of an embroidery design.

SUMMARY OF THE INVENTION

In one form, the invention comprises a software program for analyzing an embroidery design of stitches which design will be used by an embroidery machine to create an embroidered fabric. Identifying software identifies a stitch of the embroidery design which is partially or completely underlying another stitch of the embroidery design. Modification software modifies the identified underlying stitch.

In another form, the invention comprises a software program for analyzing an embroidery design of stitches which design will be used by an embroidery machine to create an embroidered fabric. Grid software divides the embroidery design to be analyzed into a plurality of grid sections. Display software provides a display of the grid sections of the divided embroidery design wherein each particular grid section has a parameter corresponding to any underlying stitches of the embroidery design within the particular grid section.

In another form, the invention comprises a system for analyzing and editing an embroidery design of stitches which design will be used by an embroidery machine to create an embroidered fabric. The system includes a personal computer, grid software and modification software. The grid software divides the embroidery design to be analyzed into a plurality of grid sections. The modification software modifying a stitch within one of the grid sections which is underlying another stitch within the grid section.

This software program and system of the invention has a number of advantages over the prior art. The software program and system provide an objective approach to reducing or eliminating underlying stitching of an embroidery pattern. Furthermore, portions of embroidery designs having underlying stitching can be identified, evaluated and possibly adjusted by the invention so that the design will be attractive and will not damage the base fabric.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE PREFERRED EMBODIMENTS

Figure 1:
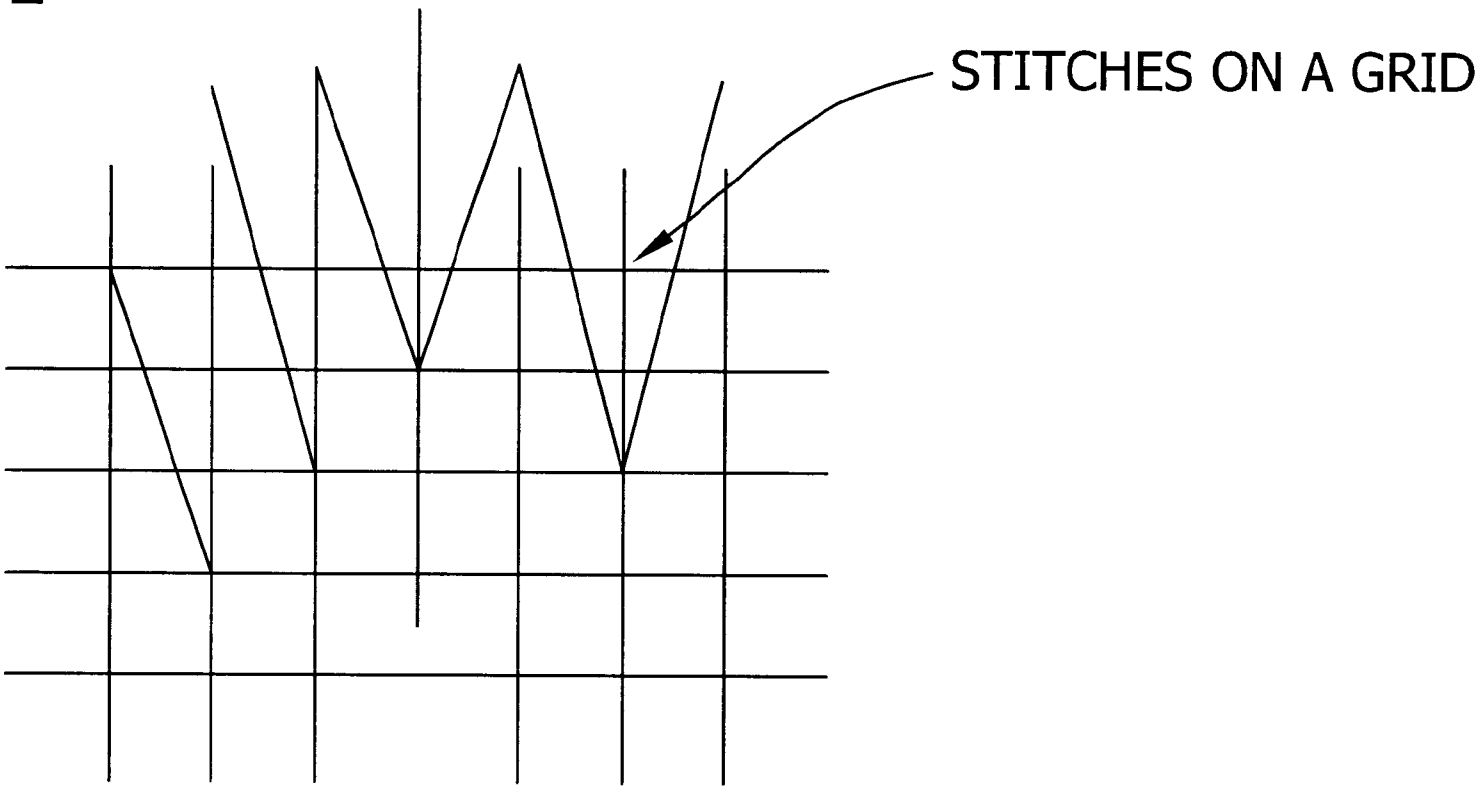
FIG. 1 is an illustration of stitching mapped onto a grid.

One purpose of the invention is provide a system and/or method which creates a set of data and/or a corresponding image on a computer that accurately represents underlying (or overlying) threads of a machine-embroidered design which design will be used by an embroidery machine to create an embroidered fabric. In one preferred form, the invention comprises software running on a personal computer which is linked to and controlling an embroidery machine. The software program analyzes the embroidery design of stitches and selectively modifies the stitches to remove or minimize any underlying stitches.

The following provides exemplary definitions of the terms used herein. These definitions are provided by way of example and not for the purpose of limiting the invention or the scope of the claims of the invention.

Definitions

Thread weight is the thickness of a particular thread. Although manufacturers differ in their systems, the accepted rule of thumb is that a 40-weight thread will fill a 1.0 mm gap with 4 threads; a 30-weight thread will fill a 1.0 mm gap with 3 threads, etc.

Design Density is a term that describes the amount of thread used in a given design. If a given design uses a lot of thread, it is considered dense; if it does not use a lot of thread, it is considered loose. There are no rules used to determine density. The majority of embroiderers will say that if you can see the fabric under the design it is considered loose. Conversely, if the needle has difficulty penetrating previously sewn areas, it is considered dense.

Embroidery File is logically organized (although differently between manufacturers) into a series of individual stitches and colors. Embroidery takes place on a Cartesian plane, using the (x, y) coordinate system. The needle of the embroidery machine will start at the origin (0, 0) and move in a series of steps, referred to as stitches. At the end of each step, the embroidery machine cycles the needle mechanism to form a stitch in the fabric. After completing a series of stitches with the same thread, the machine will stop and request that a new thread color be used.

Stitch is a term used to identify a continuous, substantially straight segment of thread which begins a one fabric penetration and ends at a second fabric penetration. In other words, a stitch is a length of thread that spans and interconnects two fabric penetration points.

Embroidery design density is affected by many factors and, in particular, the following factors:

1) The number of stitches contained within an embroidery relative to that design's total area; and
2) The added 'weight' given to the design by the threads being embroidered.

As the thread weight increases, the design density increases because the threads require more area in which to lie within the same total embroidered area of the design. As the number of underlying stitches increases, the density increases because the extra thread required to create the stitch is also occupying space in the embroidered area.

To enable a precise analysis of the underlying stitches of a design, the system and method of the invention starts by defining a grid. Each section or square of the grid represents the size of the intended thread weight. The software of the invention includes grid software for dividing the embroidery design to be analyzed into a plurality of equal squares. For instance, if the operator wishes to use a 40-weight thread, each grid will represent 0.25 mm on each edge. Each grid is assigned a corresponding value, such as a positive integer, representing the amount of thread that is sewn over the grid area.

A computer driven by software may be used to evaluate the stitches in an embroidery design. As shown in FIG. 1, a computer creates two variables in its memory: x and y. These variables are initially set to zero. As the stitch values are read from the embroidery file, the values of x and y will increase or decrease depending on the data. A computer may display such data in the form of a bitmap, or graphic representation of its data. Each pixel (dot) of the bitmap can be set to a specific color. As a result, the computer can draw an embroidery design in its memory by coloring the pixels of a bitmap to correspond with the thread that would be stitched by an embroidery machine.

Figure 2A:
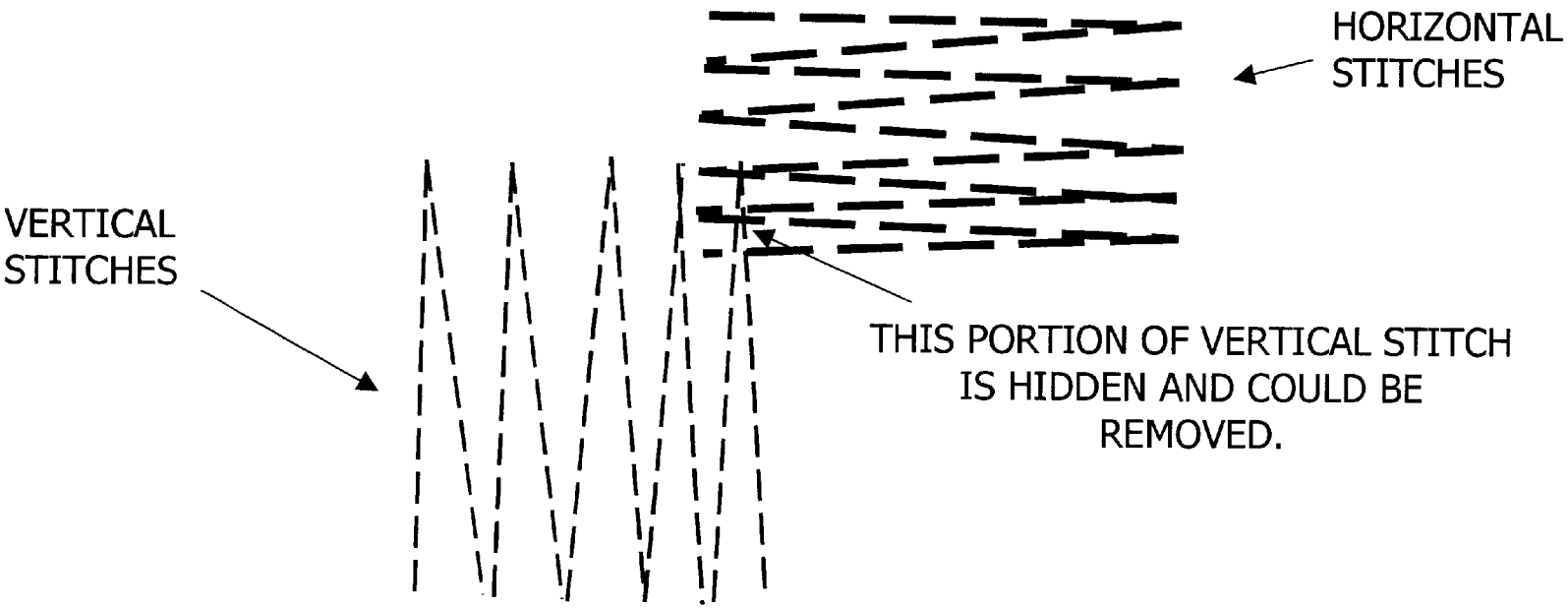
FIG. 2A is a diagram illustrating a visual representation of underlying stitching.

FIG. 2A illustrates a visual representation of underlying stitching. In this representation, the thickness of the thread has been reduced for the purpose of 'seeing' underneath the stitching. In actuality, the stitches would be wide enough to completely fill the visible area between them. In this illustration, it is assumed that the vertical stitches are applied to the embroidery fabric first and that the horizontal stitches are applied thereafter. Therefore, the portion of the vertical stitches in the upper right corner of the vertical stitch layer underlay the horizontal stitches in the lower left corner of the horizontal stitch layer. These portions of the vertical underlying stitches will not be seen and may be removed.

Figure 2B:
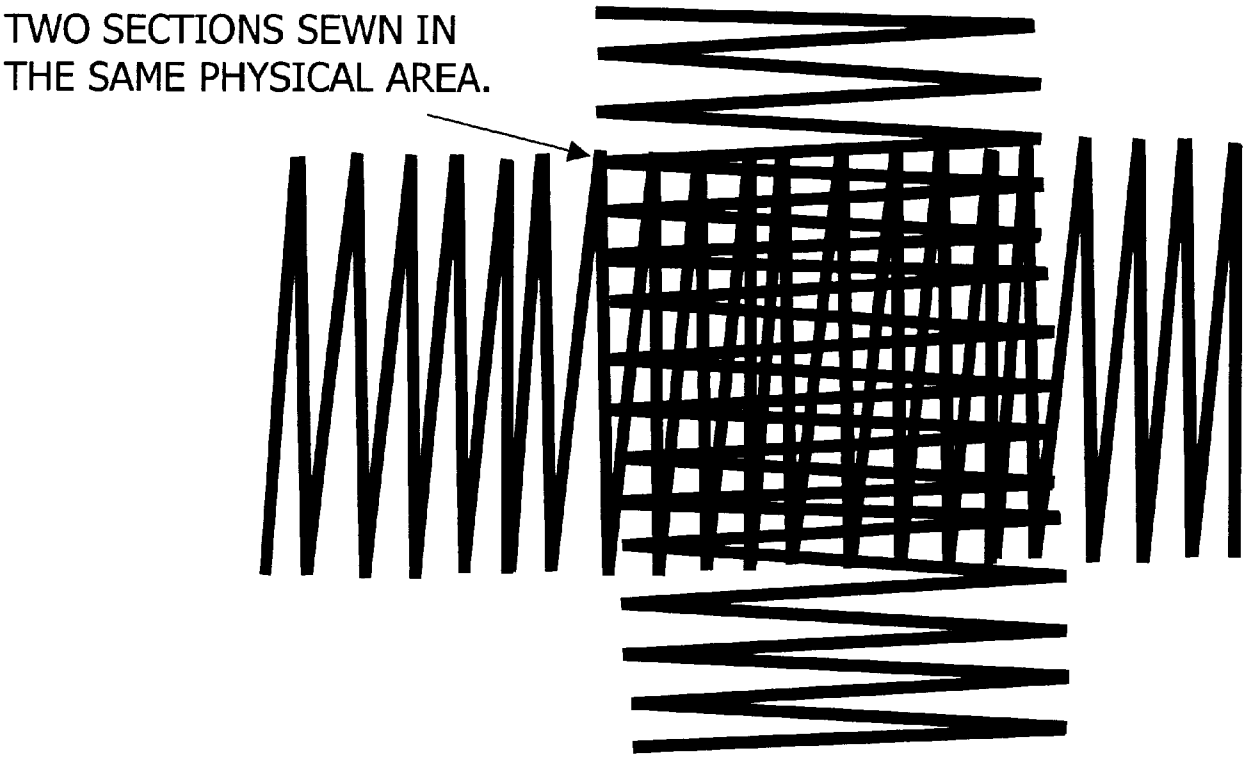
FIG. 2B is a diagram illustrating a visual representation of two sections of stitching sewn in the same physical area, a horizontal series of stitches over a vertical series of stitches.
Figure 2C:
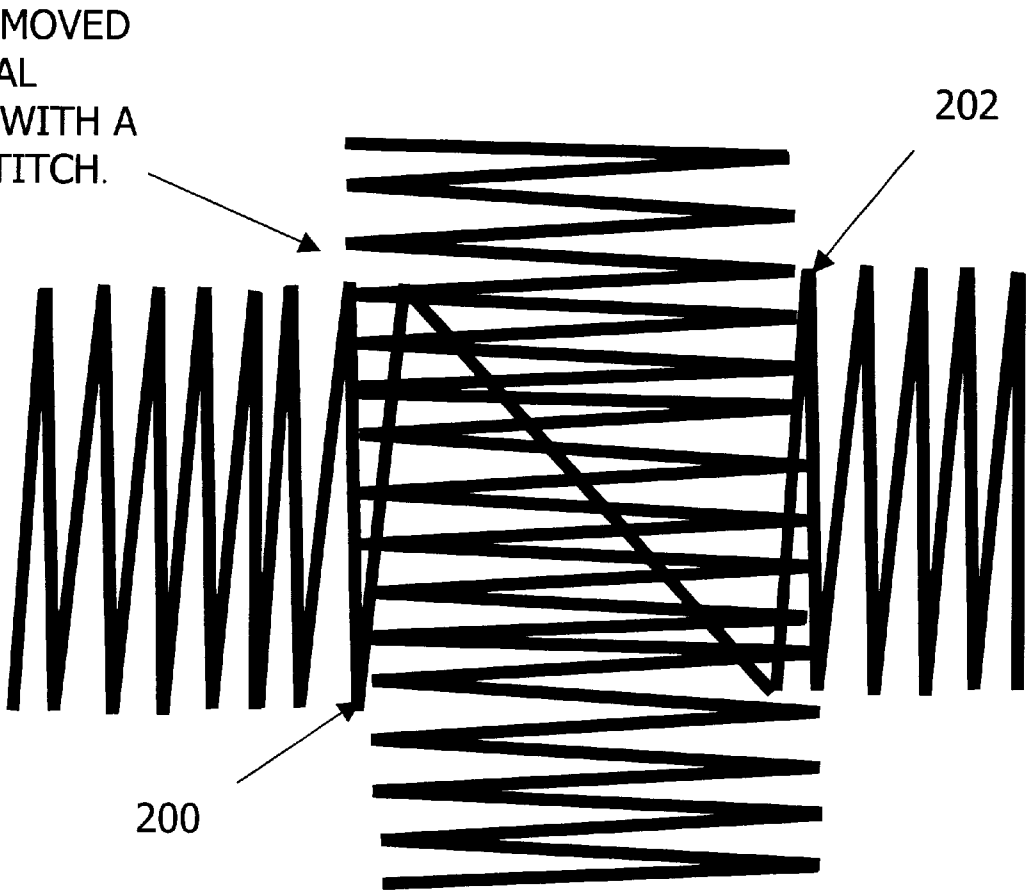
FIG. 2C is a diagram illustrating a visual representation of the two sections of FIG. 2B with the portion of the underlying vertical series replaced by a connective jump stitch.

FIG. 2B is a diagram illustrating a visual representation of two sections of stitching sewn in the same physical area, a horizontal series of stitches over a vertical series of stitches. FIG. 2C is a diagram illustrating a visual representation of the two sections of FIG. 2B with the portion of the underlying vertical series replaced by a connective jump stitch. Stitches 200 and 202 have not been removed because they are only partially overlapped by the horizontal stitches. On the other hand, the stitches between stitches 200 and 202 have been replaced by a diagonal stitch that jumps from stitch 200 to stitch 202. The diagonal stitch connects stitch 200 with stitch 202 so that the flow of vertical stitches is not interrupted and continues in a manner as originally programmed.

To remove these underlying stitches, the invention maps the embroidery design on the grid noted above to evaluate the design and determine underlying stitching. Each grid square is assigned a value representing whether or not a thread has been sewn over that square. Once such a grid is created, the design is drawn into the grid. As a thread passes over a grid square, its value is set to 1. The resulting grid contains values that accurately represent whether or not a thread covers that area of the design. Each grid square can be translated into a pixel in a computer bitmap, both in memory and on a display. When the bitmap is displayed, it can show the different values of grid squares for each color layer.

A computer program then analyzes each color layer of an embroidery design. It will start by creating such a grid based on all the colors that sew after the color layer being analyzed. It will then begin placing stitches over the same grid. If any stitch is being placed into a series of grid squares that have no visibility, then that stitch will be identified and removed from that color layer. As such, it will happen that a series of stitches at a time may be removed from the design. When the testing comes to an area that the stitch will show, a new stitch will be added that begins where the last visible stitch ends, and that ends where the next visible stitch begins. These bitmaps can be displayed onscreen to a user, and a new embroidery file can be created.

Since thread weights can differ, the user may enter the thread weight being used. Also, the amount of stretch each thread will have under the tension of being sewn can alter that weight. This number can be adjusted either specifically, using data from the thread manufacturer or empirically, based on the users experience.

Figure 3:
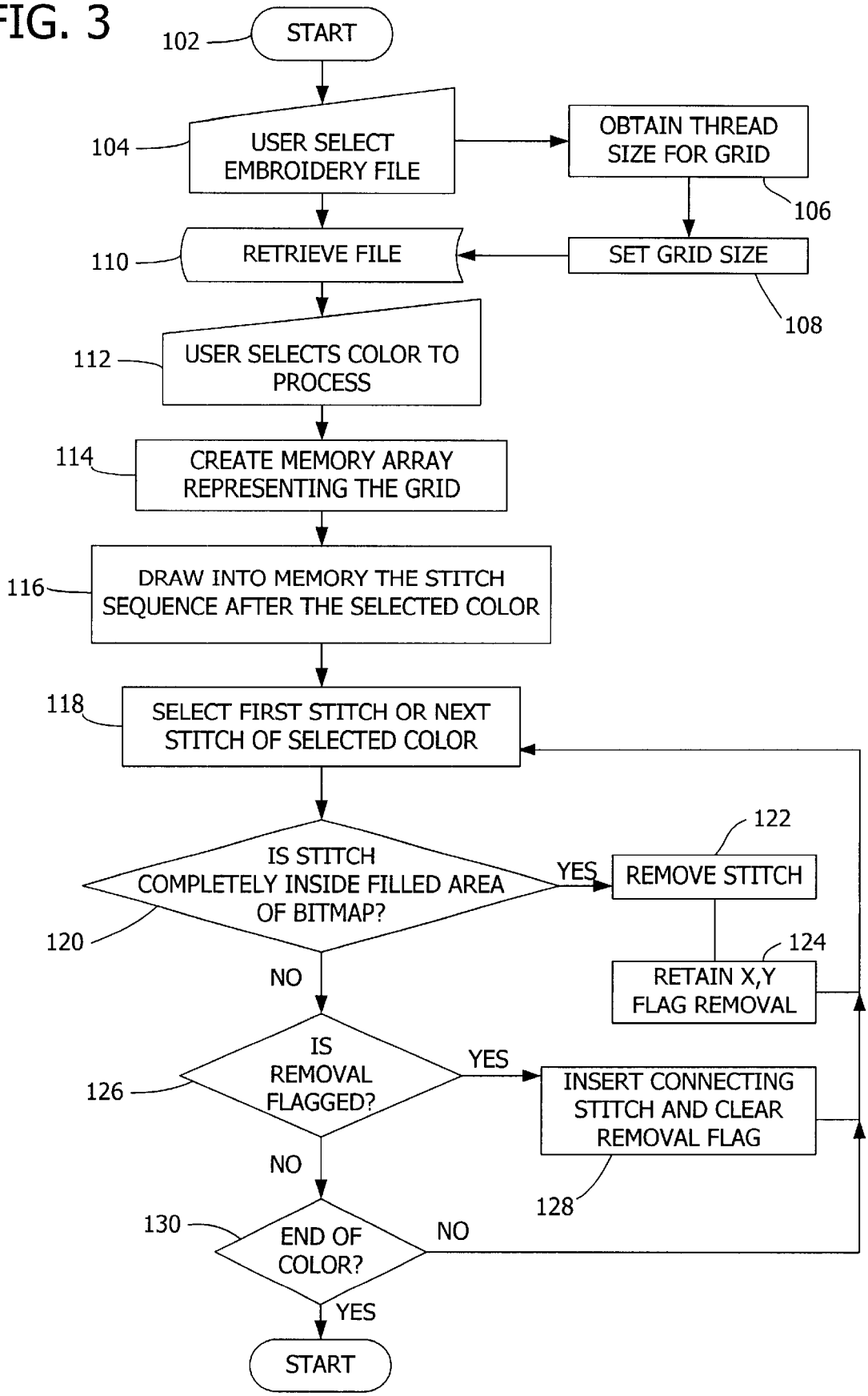
FIG. 3 is a flow chart for removing underlying stitches in a color of an embroidery design.

As illustrated in FIG. 3, the software is initialized at step 102 and the operator identifies the particular embroidery design to be manufactured so that the software can retrieve the corresponding embroidery file at step 104. At this point, the software obtains the thread size at step 106 from the retrieved file or from another file or the thread size may be designated by the operator. The software then sets the grid size at step 108 to be equal to or to otherwise correspond to the obtained thread size. Once such a grid is created, the design is drawn into the grid. At step 110, the software gets the stitch data to begin the overlay analysis of the design.

At step 112, the user (or the software) selects the particular color layer to be processed. At step 114, the software creates a memory array representing the grid for the selected color layer. This portion of the software constitutes grid software for dividing the embroidery design to be analyzed into a plurality of grid sections.

At step 116, the software proceeds to execute a subroutine which will draw into the memory created by step 114 the stitch sequence after the selected color layer, i.e., all subsequent stitches, some of which could overlay the selected color layer. The first step of this subroutine is step 118 wherein the software selects the first stitch of the selected color layer. At step 120, the software determines whether the selected stitch is completely inside the filled area of the bitmap (e.g., the grid square). This portion of the software is identifying software for identifying a stitch of the embroidery design which is partially or completely underlying another stitch of the embroidery design. As a result of the grid created by step 114, the identifying software identifies each grid section having a stitch which is partially or completely underlying another stitch.

In other words, if the stitch from beginning to ending (i.e., from penetration point to penetration point) is covered by other stitches, the software proceeds to step 122 to remove the stitch and then to step 124 to retain the x, y coordinates of the removed stitch and to set a removal flag for the retained coordinates. This portion of the software constitutes flag software for setting a flag corresponding to each particular grid section having an underlying stitch of the embroidery design within a particular grid section. The software then returns to step 118 to select the next stitch sequence.

As noted above, at step 120, the software determines whether the selected stitch is completely inside the filled area of the bitmap. In the event that the selected stitch is NOT completely within the filled area, the software proceeds to step 126. If removal has been previously flagged, meaning that a series of one or more previous stitches have been found to be completely within the filled area of the bitmap and has been removed, a connecting stitch is inserted by step 128 to bridge the series of removed stitches and to interconnect the last stitch which was not removed and the next stitch which will not be removed. This connecting stitch begins where the last visible stitch ends, and ends where the next visible stitch begins. If the removal has not been previously flagged, no modification is implemented at this point since no previous, contiguous stitches have been identified as an underlying stitch and removed. [Alternatively, only one underlying stitch not adjacent any other underlying stitches may not be removed because the connecting stitch replacing the underlying stitch becomes the equivalent to the underlying stitch. Therefore, no design modification is needed for single, isolated underlying stitches.] The software then proceeds to step 130 to determine whether to continue with step 118 (if there are additional stitches of the color which have not been analyzed) or to end (when all stitches of the particular color or layer have been analyzed).

The above noted portion of the software constitutes modification software for modifying the identified underlying stitch. In particular, it removes underlying stitches or a portion thereof in each identified grid section. Preferably, the modification software removes a particular underlying stitch only when another stitch fully overlays the particular underlying stitch. The modification software removes underlying stitches or a portion thereof of the particular grid in response to the set flag of the particular grid (see step 124, 128). It is contemplated that a portion of a stitch may be removed. For example, a partially underlying stitch may be replaced by two or more substitute stitches and each substitute stitch which is underlying other stitches may then be removed.

Figure 4:
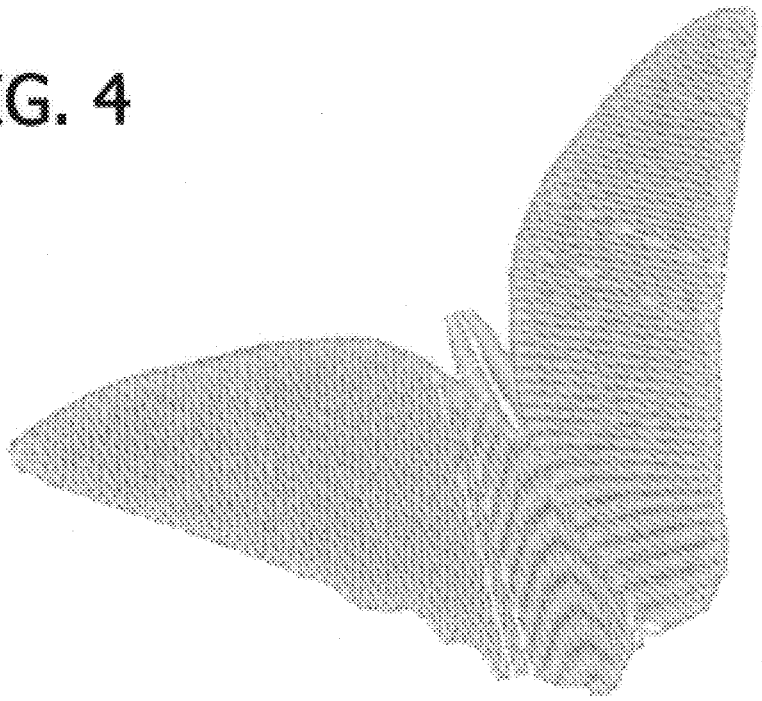
FIG. 4 is an illustration of the yellow layer of a butterfly embroidery design before the underlying stitching has been removed.
Figure 5:
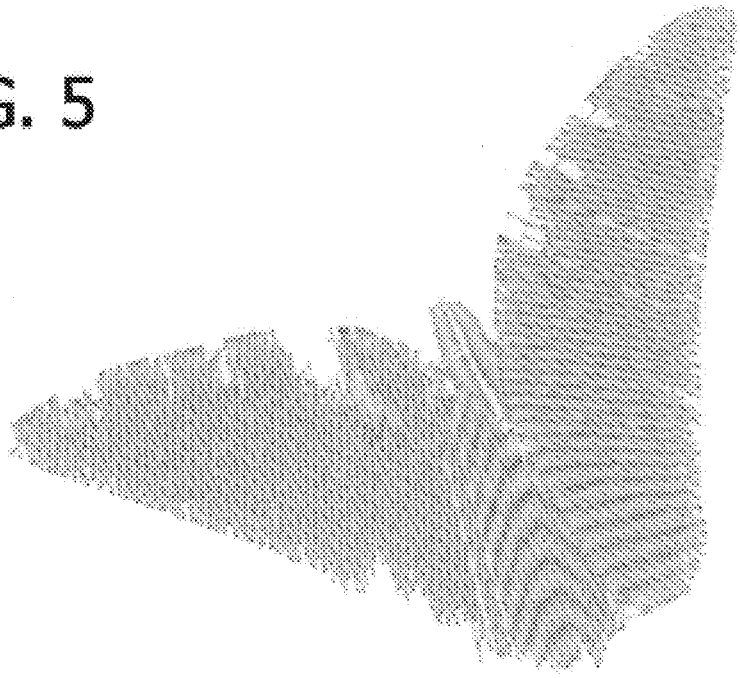
FIG. 5 is an illustration of the yellow layer of a butterfly embroidery design of FIG. 4 after the underlying stitching has been removed.

FIG. 4 illustrates a yellow section or layer of a multi-color butterfly embroidery pattern the pattern has been analyzed by the above software of the invention and before underlying stitching has been removed. It is assumed that other sections or layers of other colors which are more dominant than yellow will be applied over the yellow section or layer. Evaluating FIG. 4 by the software of the invention results in FIG. 5. In FIG. 5, underlying stitches and portions thereof have been removed to minimize material needs, to minimize fabric damage and to reduce the time required to generate an embroidered fabric from the design. In FIG. 5, is can be seen that stitches along the edges of the section or layer have been removed. In FIGS. 4 and 5, each yellow stitch is represented by a black line. Because of the closeness of the stitching, the sections of FIGS. 4 and 5 appear as a solid black surface when, in fact, the sections are made up of a plurality of stitches.

Alternatively, after the analysis of FIG. 3 is completed, display software may be optionally used to display the embroidery design by illustrating the design or a layer thereof before and after any overlying or underlying stitches have been removed. In particular, FIGS. 4 and 5 may be generated for the operator's consideration. This display will assist the operator in evaluating the changes made by the software of the invention. Also, the display software may provide a display of the grid sections of the divided embroidery design wherein each particular grid section has a parameter (color, intensity, a numeral value, a distinctive pattern, etc.) corresponding to any underlying stitches of the embroidery design within the particular grid section.

In view of the above, it will be seen that the several objects of the invention are achieved and other advantageous results attained.

As various changes could be made in the above products and methods without departing from the scope of the invention, it is intended that all matter contained in the above description and shown in the accompanying drawings shall be interpreted as illustrative and not in a limiting sense.

What is claimed is:

1. A software program for analyzing an embroidery design having a plurality of stitches represented by embroidery stitch data which design will be used by an embroidery machine to create an embroidered fabric, wherein the embroidery stitch data includes stitch data of one or more stitches of the embroidery design which is partially or completely underlying another stitch of the embroidery design, said software program comprising:

identifying software for identifying underlying stitch data within the embroidery stitch data representing a stitch of the embroidery design which is partially or completely underlying another stitch of the embroidery design; and modification software for modifying the identified underlying stitch data.

2. The software program of claim 1 further comprising:

grid software for dividing the embroidery stitch data into a plurality of grid sections;

identifying software for identifying each grid section having the identified underlying stitch data and modification software for modifying the identified underlying stitch data to remove data representing the underlying stitch or a portion thereof in each identified grid section.

3. The software program of claim 1 further comprising display software for providing a display corresponding to the embroidery stitch data illustrating the design or a layer of the embroidery design before and after the underlying stitch data has been modified.

4. The software program of claim 1 wherein the modification software removes underlying stitch data representing a particular underlying stitch only when another stitch fully overlays the particular underlying stitch.

5. The software program of claim 1 wherein the modification software removes identified underlying stitch data representing a series of two or more stitches that are underlying other stitches of the embroidery design and inserts connecting stitch data of a connecting stitch to replace the removed underlying stitch data.

6. The software program of claim 2, wherein each grid section has a size corresponding to a diameter of a thread to be used to create the embroidered fabric.

7. The software program of claim 6 wherein the size of each grid section is increased or decreased in proportion to a stretch of the thread to be used to create the embroidered fabric.

8. A software program for analyzing an embroidery design having a plurality of stitches represented by embroidery stitch data which design will be used by an embroidery machine to create an embroidered fabric, wherein the embroidery stitch data includes stitch data of one or more stitches of the embroidery design which is partially or completely underlying another stitch of the embroidery design, said software program comprising:

grid software for dividing the embroidery stitch data into a plurality of grid sections; and display software for providing a display of the grid sections corresponding to the divided embroidery stitch data wherein each particular grid section has a parameter corresponding to any underlying stitch data of the embroidery stitch data within the particular grid section.

9. The software program of claim 8 further comprising:

flag software for setting a flag corresponding to each particular grid section having underlying stitch data within the particular grid section; and modification software for modifying the underlying stitch data to remove underlying stitch data or a portion thereof of the particular grid in response to the set flag of the particular grid.

10. The software program of claim 8 further comprising:

identifying software for identifying underlying stitch data within the embroidery stitch data representing a stitch of the embroidery design which is partially or completely underlying another stitch of the embroidery design; and modification software for modifying the identified underlying stitch data.

11. The software program of claim 8 further comprising:

identifying software for identifying each grid section having underlying stitch data; and modification software for modifying the identified underlying stitch data to remove the underlying stitch data or a portion thereof in each identified grid section.

12. The software program of claim 10 further comprising display software for providing a display corresponding to the embroidery stitch data illustrating the design or a layer of the embroidery design before and after the underlying stitch data has been modified.

13. The software program of claim 10 wherein the modification software removes underlying stitch data representing a particular underlying stitch only when another stitch fully overlays the particular underlying stitch.

14. The software program of claim 10 wherein the modification software removes identified underlying stitch data representing a series of two or more stitches which are underlying other stitches of the embroidery design and inserts connecting stitch data of a connecting stitch to replace the removed underlying stitch data.

15. The software program of claim 8, wherein each grid section has a size corresponding to a diameter of a thread to be used to create the embroidered fabric.

16. The software program of claim 15, wherein the size of each grid section is increased or decreased in proportion to a stretch of the thread to be used to create the embroidered fabric.

17. A system for analyzing an embroidery design having a plurality of stitches represented by embroidery stitch data which design will be used by an embroidery machine to create an embroidered fabric, wherein the embroidery stitch data includes stitch data of one or more stitches of the embroidery design which is partially or completely underlying another stitch of the embroidery design, said system comprising:

a personal computer including:

grid software for dividing the embroidery stitch data into a plurality of grid sections; and modification software for modifying underlying stitch data within the embroidery stitch data representing a stitch within a particular grid section which is underlying another stitch within the particular grid section.

18. The system of claim 17 further comprising display software for providing a display corresponding to the embroidery stitch data illustrating the design or a layer of the embroidery design before and after the underlying stitch data has been modified.

19. The system of claim 17 wherein the modification software removes underlying stitch data representing a particular underlying stitch only when another stitch fully overlays the particular underlying stitch.

20. The system of claim 17 wherein the modification software removes underlying stitch data representing a series of two or more stitches which are underlying other stitches of the embroidery design and inserts connecting stitch data of a connecting stitch to replace the removed underlying stitch data.

21. The system of claim 17 wherein each grid section has a size corresponding to a diameter of a thread to be used to create the embroidered fabric.

22. A software program for analyzing an embroidery design having a plurality of stitches represented by embroidery stitch data which design will be used by an embroidery machine to create an embroidered fabric, wherein the embroidery stitch data includes stitch data of one or more stitches of the embroidery design which is partially or completely underlying another stitch of the embroidery design, said embroidery stitch data comprising a plurality of layers, each layer of which corresponds to a color, the software program comprising:

grid software for dividing the embroidery stitch data of a particular color layer into a plurality of grid sections and for dividing embroidery stitch data representing stitches of other color layers to be embroidered subsequent to stitches of the particular color layer;

identifying software for identifying underlying stitch data within the particular color layer representing an underlying stitch which is partially or completely underlying another stitch of another color layer; and modification software for removing identified underlying stitch data representing a series of two or more underlying stitches of the particular color layer which are partially or completely underlying other stitches of another color layer and inserting connecting stitch data within the particular color layer of a connecting stitch to replace the removed underlying stitch data.

23. The software program of claim 1 wherein the modification software removes a portion of the identified underlying stitch data representing a particular underlying stitch when another stitch partially overlays the particular underlying stitch.

24. The software program of claim 1 wherein the modification software replaces the underlying stitch data representing a particular partially underlying stitch with substitute underlying stitch data of two or more substitute stitches and removes substitute underlying stitch data of each substitute stitch which is completely underlying another stitch.

* * * * *